US009670559B2

(12) United States Patent
Hwang et al.

(10) Patent No.: US 9,670,559 B2
(45) Date of Patent: Jun. 6, 2017

(54) METHOD OF ADDING HIGH VAPOR PRESSURE MAGNESIUM TO STEEL LIQUID AND APPARATUS FOR PERFORMING THE METHOD

(71) Applicant: National Cheng Kung University, Tainan (TW)

(72) Inventors: Weng-Sing Hwang, Tainan (TW); Jian Zhang, Chongqing (CN); Cheng-Qian Zhang, Tianjin (CN); Hsin-Ying Tseng, Kaohsiung (TW); Yen-Hao Su, Kaohsiung (TW); Muh-Jung Lu, Kaohsiung (TW)

(73) Assignee: National Cheng Kung University, Tainan (TW)

( * ) Notice: Subject to any disclaimer, the term of this patent is extended or adjusted under 35 U.S.C. 154(b) by 23 days.

(21) Appl. No.: 14/791,518

(22) Filed: Jul. 6, 2015

(65) Prior Publication Data

US 2017/0009310 A1 Jan. 12, 2017

(51) Int. Cl.
*C21C 7/00* (2006.01)
*C21C 7/06* (2006.01)

(52) U.S. Cl.
CPC ..... *C21C 7/0006* (2013.01); *C21C 7/0037* (2013.01); *C21C 7/06* (2013.01)

(58) Field of Classification Search
CPC ..... C21C 5/20; C21C 5/25; C21C 7/0006
See application file for complete search history.

(56) References Cited

U.S. PATENT DOCUMENTS 4,630,802 A * 12/1986 Frykendahl ..... B22D 1/00 266/216
4,811,782 A * 3/1989 Sola ..... C21C 1/10 164/495
6,409,962 B1 * 6/2002 Lawson ..... C21C 7/0037 266/216

FOREIGN PATENT DOCUMENTS

CN 203079321 U * 7/2013
DE 2451991 A1 * 5/1976 ..... C21C 1/02
(Continued)

OTHER PUBLICATIONS

Lauff, Helmut et al. DE 2451991 A1 published May 13, 1976. Machine translation.*

(Continued)

*Primary Examiner* — George Wyszomierski
*Assistant Examiner* — Tima M McGuthry Banks
(74) *Attorney, Agent, or Firm* — Alan D. Kamrath; Kamrath IP Lawfirm, P.A.

(57) ABSTRACT

An apparatus of adding high vapor pressure magnesium to a steel liquid, includes a magnesium additive device and a tube furnace. The magnesium additive device includes a storage barrel, a conveying pipe, a control valve, and an insertion tube. A method of adding high vapor pressure magnesium to a steel liquid, includes placing the magnesium additive device in the tube furnace, and delivering pure magnesium particles into the storage barrel. When the temperature at the mediate lower position of the conveying pipe is increased to reach a preset value, the control valve is opened to pour the pure magnesium particles into the conveying pipe to form a magnesium vapor, and an argon regulating valve is opened to introduce the argon into the conveying pipe so as to add the magnesium vapor to a steel liquid by carrying of the argon.

4 Claims, 4 Drawing Sheets

(56) References Cited

FOREIGN PATENT DOCUMENTS

| | | | | | |
|---|---|---|---|---|---|
| GB | 1434650 | A | * | 5/1976 | ..... C21C 7/0037 |
| JP | 2012219318 | A | * | 11/2012 | |

OTHER PUBLICATIONS

Zhou, Tao. CN 203079321 U published Jul. 2013. Machine translation.*

Tamura, Kosaku. JP 2012219318A published Nov. 2012. Machine translation.*

* cited by examiner

| Steel product | Oxygen content demand |
|---|---|
| IF steel | T[O] ≤40ppm, |
| Automotive & deep-drawing sheet | T[O] ≤20ppm |
| Draw and ironed cans | T[O] ≤20ppm |
| Alloy steel bars | T[O] ≤10ppm |
| Line pipe | T[O] ≤20ppm |
| Ball bearings | T[O] ≤10ppm |
| Tire cord | T[O] ≤15ppm |
| Heavy plate steel | T[O] ≤20ppm |
| Wire | T[O] ≤30ppm |
| Spring steel | T[O] ≤20ppm |

FIG. 1
PRIOR ART

METHOD OF ADDING HIGH VAPOR PRESSURE MAGNESIUM TO STEEL LIQUID AND APPARATUS FOR PERFORMING THE METHOD

BACKGROUND OF THE INVENTION

1. Field of the Invention

The present invention relates to a magnesium additive device and, more particularly, to a method of adding high vapor pressure magnesium to a steel liquid and an apparatus for performing the method.

2. Description of the Related Art

Steelmaking is an oxidation refining process, namely, to blow oxygen into a hot metal, to remove excessive elements (C, Si, Mn) and impurities (S, P) contained in the ingot iron. The maximum oxygen content in the steel liquid is up to 0.1% during the final steelmaking stage by the effect of oxygen blowing steelmaking. However, the solubility of oxygen in the solid steel is very low (e.g., maximum solubility in δ-Fe is 0.0082%). The excessive oxygen is in the form of FeO or other oxides in the process of solidification, thereby reducing the performance of the steel. Therefore, it is necessary to remove the oxygen from the steel liquid at the end of decarbonization. The oxygen in the steel includes $[O]_D$ and $[O]_L$. Deoxidization is to add a deoxidant (such as manganese, silicon, titanium, aluminum, magnesium, etc.) to the liquid steel, so as to reduce the oxygen content in the steel. In general, the total oxygen content T[O] in the steel represents the cleanliness of the steel liquid.

The oxygen content in the steel is closely related to the quality of the product. FIG. 1 is a table showing an oxygen content demand of a conventional steel product. Thus, it is important to reduce the oxygen content in the steel so as to enhance the cleanliness purity of the steel.

The alloys having a deoxidizing capacity include a weak deoxidant (such as manganese, silicon, titanium, etc.) and a strong deoxidant (such as aluminum, magnesium, etc.). The weak deoxidant, such as manganese or silicon, has a poor deoxidizing capacity so that the oxygen content in the steel is high. The strong deoxidant, such as aluminum, has an excellent deoxidizing capacity so that the oxygen content in the steel is low. For example, studies have shown that, when the aluminum content dissolved in the steel is about 0.03% to 0.05%, the average oxygen content in the steel is reduced to 3 ppm or less. Thus, the aluminum is often used as a deoxidant in the steelmaking industry. However, after the aluminum deoxidization process, the cluster inclusion $Al_2O_3$ contained in the steel will greatly reduce the ductility, toughness, fatigue strength and corrosion resistance of the steel. Especially, the cluster inclusion $Al_2O_3$ contained in the steel undermines the continuity of the steel substrate, resulting in a material failure under actions of static load and dynamic load, to reduce the steel production yield and the product quality.

The magnesium has a strong chemical activity so that Mg in the steel liquid has a strong affinity for the non-metallic elements. Thus, it is possible to use the magnesium as a deoxidant. Tateyama used a cored wire made of magnesium (Mg, MgO, CaF2) to perform deoxidization and desulfurization experiments in a reaction furnace that is protected by a low-carbon steel argon. The adding amount of magnesium is less than 15%. The T[O] value in the liquid steel is down to 9 ppm and the [S] value in the liquid steel is down to 3 ppm after five minutes. The T[O] and [S] values are not raised after ten minutes and are kept at 11 ppm and 3 ppm respectively. Therefore, it can be seen that, Mg has a strong affinity with S and O in the steel liquid, without changing the composition of the steel liquid, so that Mg is an ideal deoxidant and desulfurizer.

In fact, in the steel production process, the gas injection method is used to inject the passivation magnesium particles into the hot metal to achieve the purpose of desulfurization of the hot metal. A similar method is used to add the magnesium to the hot metal to produce a nodular cast iron. FIG. 2 is a graph showing the relationship of the vapor pressure and the temperature of Mg and Al. As shown in FIG. 2, Mg has a very high vapor pressure (200 times of that of aluminum) under the steelmaking temperature (1600° C.). Obviously, the steel liquid temperature (1600° C.) is much higher that the hot metal temperature (1300-1400° C.), so that the gas injection method of injecting the passivation magnesium particles cannot be directly used to the magnesium procedure in the steel liquid. Thus, the important core of the magnesium procedure in the steel liquid is how to add magnesium into the steel liquid safely with a high gain under the steelmaking temperature of 1600° C.

The conventional methods of adding the magnesium into the steel liquid include a pouring method, a cored wire method and a plunging method. The pouring method is to pour the magnesium particles from the steel liquid into a ladle. The added alloys include rare earth magnesium alloy, high magnesium alloy and passivated magnesium particles.

Another special structure includes a cored wire injection system which feeds a magnesium cored wire deeply into the steel liquid. Obviously, when the magnesium cored wire reaches the bottom of the steel liquid, the phase change of the magnesium is as follows: Mg(s)→Mg(l)→Mg(g). A large temperature change occurs between the magnesium cored wire and the steel liquid, so that the process of Mg(s)→Mg(g) is finished in a very short period of time. Thus, a very large pressure is produced during the vaporized process of the magnesium, so that the steel liquid is easily stirred to cause accidents. An aluminothermic reduction method is used to produce a Mg vapor, with the argon functioning as a carrier to introduce the Mg vapor into a steel liquid.

BRIEF SUMMARY OF THE INVENTION

The primary objective of the present invention is to provide a method of adding high vapor pressure magnesium to a steel liquid and an apparatus for performing the method.

In accordance with one feature of the present invention, there is provided an apparatus of adding high vapor pressure magnesium to a steel liquid, comprising a magnesium additive device and a tube furnace. The magnesium additive device comprises a storage barrel, a main body, a control valve, and an insertion tube. The storage barrel is a closed container arranged at the uppermost end. The main body has a hollow tubular shape and is combined with the storage barrel tightly and closely to form a conveying pipe. The control valve is mounted between the storage barrel and the conveying pipe to adjust pure magnesium particles in the storage barrel. The insertion tube is mounted in the conveying pipe and has a closed shape. The insertion tube has a bottom provided with a plurality of air holes.

Preferably, each of the air holes of the insertion tube has a diameter smaller than that of each of the pure magnesium particles.

In accordance with another feature of the present invention, there is provided a method of adding high vapor pressure magnesium to a steel liquid, comprising placing a magnesium additive device in a tube furnace, and adding pure magnesium particles when a temperature at a mediate lower position of the magnesium additive device is increased to reach a preset value, so that the pure magnesium particles form a magnesium vapor which is carried into a steel liquid by argon.

Preferably, the method further comprises providing an argon regulating valve to introduce the argon whose flow rate is at the range of 0.5-1.5 L/min.

When the flow rate of the argon is smaller than 0.2 L/min, the argon gas bubble formed at the bottom of the steel liquid is too large so that the magnesium contained in the argon gas bubble is not easily transmitted to the steel liquid, and when the flow rate of the argon is greater than 0.5 L/min, the magnesium vapor pressure on the surface of the steel liquid is too low, thereby decreasing the recovery ratio of the magnesium. Thus, the flow rate of the argon is preferably at the range of 0.2-0.5 L/min.

When the diameter of each of the pure magnesium particles is smaller than 0.5 mm, the pure magnesium particles will pass through the insertion tube in the conveying pipe to contact the steel liquid, and when the diameter of each of the pure magnesium particles is greater than 2 mm, the pure magnesium particles cannot pass through the control valve into the conveying pipe. Thus, each of the pure magnesium particles preferably has a diameter of 0.5-2 mm.

In conclusion, the magnesium additive device is initially placed into the tube furnace. Then, the pure magnesium particles with a diameter of 0.5-2 mm is put into the storage barrel. When the temperature at the mediate lower position of the conveying pipe is increased to reach a preset value at the range of 1120° C. to 1200° C., the control valve is opened to pour the pure magnesium particles into the conveying pipe to form a magnesium vapor, and the argon regulating valve is opened to introduce the argon into the conveying pipe at a flow rate which is at the range of 0.2-0.5 L/min so as to add the magnesium vapor to the steel liquid by carrying of the argon.

Accordingly, the magnesium has a melting point of 670° C. and has a boiling point of 1100° C., so that the vapor pressure of the magnesium will reach 20-25 atm under the steelmaking temperature of 1600° C. If the magnesium at a solid state is directly poured into the steel liquid, the steel liquid is inevitably stirred violently or even blasts, and the recovery ratio of the magnesium is dropped largely. Therefore, by the method and apparatus of the present invention, the magnesium is added to the steel liquid safely and efficiently to solve the above-mentioned problems.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 1 is a table showing an oxygen content demand of a conventional steel product in accordance with the prior art.

DETAILED DESCRIPTION OF THE INVENTION

Figure 2:
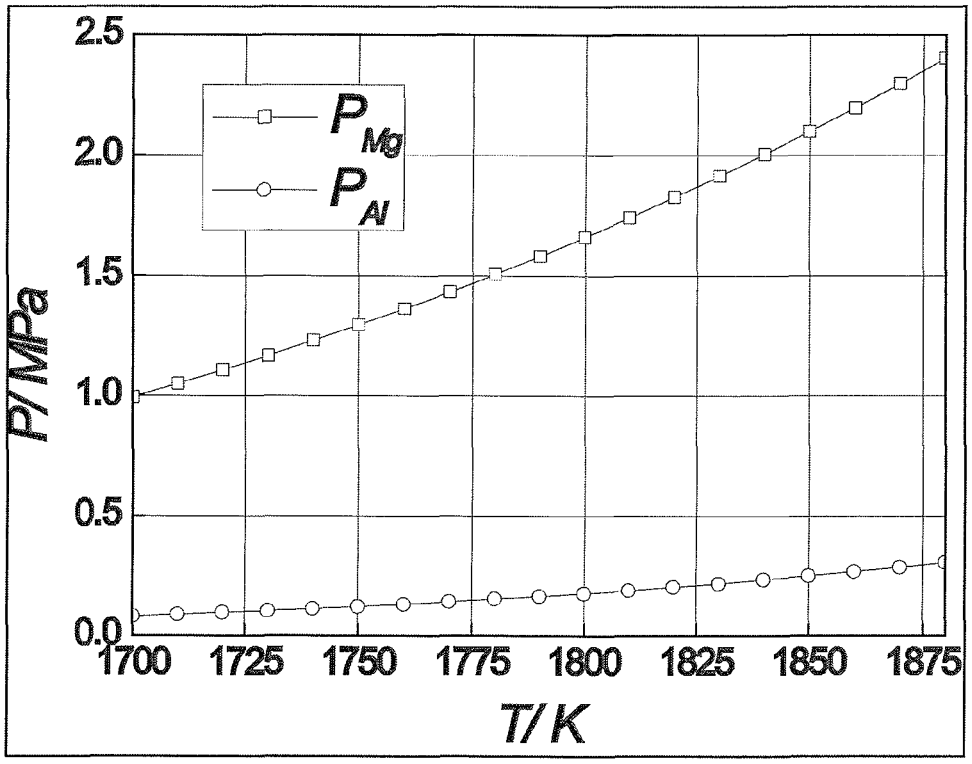
FIG. 2 PRIOR ART
FIG. 2 is a graph showing the relationship of the vapor pressure and the temperature of Mg and Al in accordance with the prior art.
Figure 3:
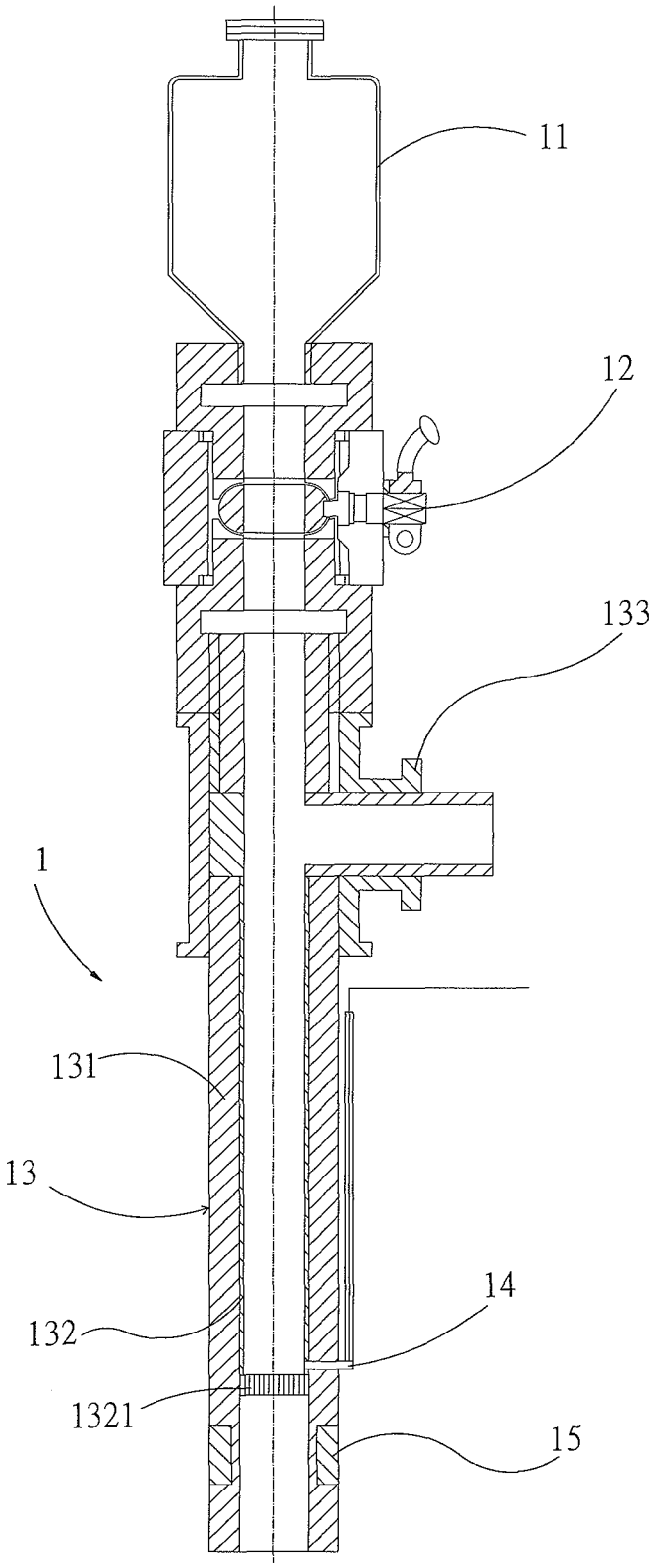
FIG. 3 is a cross-sectional view of a magnesium additive device in accordance with the preferred embodiment of the present invention
Figure 4:
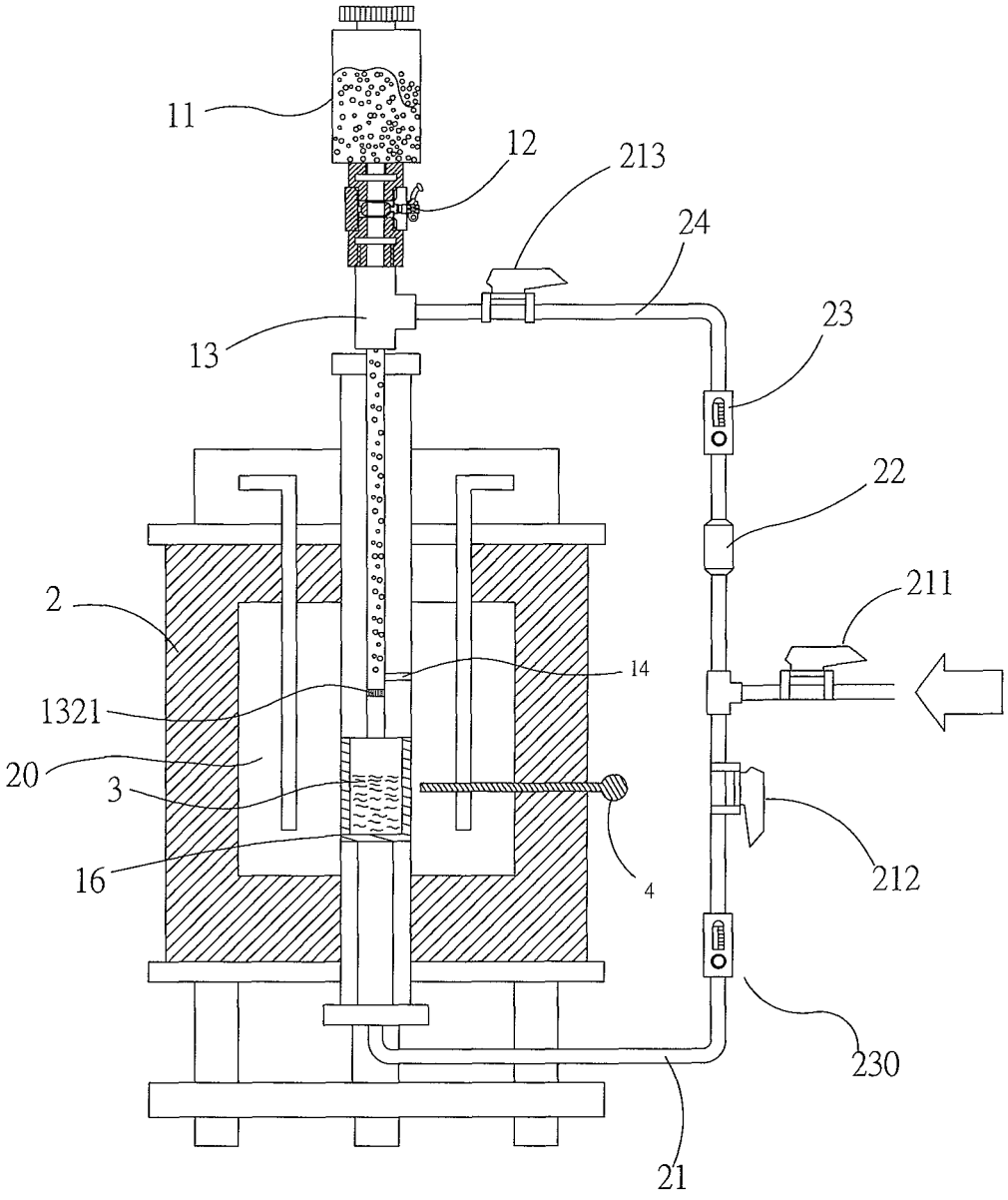
FIG. 4 is a cross-sectional assembly view of the magnesium additive device and a tube furnace in accordance with the preferred embodiment of the present invention.

Referring to FIGS. 3 and 4, a magnesium additive device 1 in accordance with the preferred embodiment of the present invention comprises a storage barrel 11, a control valve 12 and a main body 13. The main body 13 has a conveying pipe 131. An insertion tube 132 is mounted in a hollow interior of the conveying pipe 131. The insertion tube 132 has a sealed bottom provided with a plurality of air holes 1321. A three-way pipe 133 is mounted on a side wall of the conveying pipe 131 to allow entrance of argon. A temperature sensor 14 is mounted on the bottom of the insertion tube 132. A corrosion resistant coating 15 is formed on an inner all of the main body 13. The above-mentioned elements are connected tightly and closely to prevent entrance of air.

The magnesium additive device 1 is mounted in a tube furnace 2 which has a hollow interior 20. The upper and lower ends of the magnesium additive device 1 are respectively connected by a line 21 which is provided with valves 211, 212 and 213 which are located at different positions. A gas purifier 22 is mounted on the line 21 and located between the valves 211 and 213. The line 21 is also provided with flow meters 23 and 230. The line 21 has an upper end provided with a gas conveying pipe 24 connected to the valve 213. The tube furnace 2 includes a crucible 16 mounted in an inner wall of the magnesium additive device 1 for receiving a steel liquid 3. A temperature detector 4 is mounted on an outer wall of the tube furnace 2.

The important core of the present invention is how to add magnesium into the steel liquid 3 safely with a high gain under the steelmaking temperature of 1600° C.

When in use, the valves 211, 212 and 213 are opened. Then, the valve 212 is regulated so that the flow rate of the flow meter 230 is at the range of 1-2 L/min. At the same time, argon is introduced through the valve 211 into the line 21 during a time interval of ten minutes so that the oxygen pressure in the tube furnace 2 is reduced to the minimum. Then, magnesium with a diameter of 0.5-2 mm is poured into the storage barrel 11, and the valve 213 is regulated so that the flow rate of the flow meter 23 is at the range of 0.5-1 L/min to pass the argon during a time interval of five minutes. Then, the valve 213 is closed. Then, the tube furnace 2 is energized to increase the temperature in the crucible 16 of the tube furnace 2 to 1600° C. so that the steel in the crucible 16 is melted completely to form the steel liquid 3 whose temperature is distributed evenly.

At this time, the magnesium additive device 1 is located above the crucible 16 of the tube furnace 2. When the temperature sensor 14 detects that the temperature of the magnesium is kept constantly at the range of 1120° C. to 1200° C., the control valve 12 is opened to introduce the magnesium from the storage barrel 11 into the insertion tube 132 at a determined speed, so that the magnesium is vaporized under the high temperature to form a magnesium vapor. At this time, the valve 213 is opened to introduce the argon at the flow rate of 0.2-0.5 L/min to accomplish the process of adding the magnesium to the steel liquid 3.

Accordingly, in accordance with the present invention, the technology of adding the high vapor pressure magnesium to the steel liquid 3 has the following advantages. The present invention adds the pure magnesium to the steel liquid 3 without introducing other element, thereby preventing the component of the steel liquid 3 from being complicated. In addition, the characteristic of the present invention is in that, after the magnesium is vaporized, the argon functions as a carrier to add the magnesium vapor to the steel liquid 3 so as to prevent the solid magnesium particles from directly contacting the steel liquid 3 and to prevent from incurring the danger of explosion. Further, the argon functions as a protective gas during the process to prevent the magnesium from directly contacting the air. Further, the temperature of the hollow interior 20 of the tube furnace 2 is kept at the range of 1120° C. to 1200° C. to vaporize the solid magnesium, without having to additionally provide a heating device. Further, the solid magnesium is vaporized at the temperature range of 1120° C. to 1200° C., and the vapor pressure of the magnesium is only 4 atm under such a temperature range. Further, the insertion tube 132 is made of a stainless steel that can tolerate a high temperature so that the conveying pipe 131 will not be broken during the magnesium vaporizing process. Further, the argon functions as a carrier when the magnesium vapor is added to the steel liquid 3 so that the magnesium is distributed evenly in the steel liquid 3. Further, when the magnesium is added to the steel liquid 3, the magnesium has a better recovery ratio. Further, the quantity of the magnesium added into the insertion tube 132 is controlled by the storage barrel 11, and the time interval of adding the magnesium is controlled so as to exactly control the magnesium content in the steel liquid 3.

In conclusion, the magnesium is added to the steel liquid 3 safely and stably, without having to introduce other alloy element, so that the cost of production is low, the magnesium recovery ratio is high, and the magnesium is distributed evenly in the steel liquid 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A method of adding high vapor pressure magnesium to a steel liquid, comprising:

placing a magnesium additive device in a tube furnace; and adding pure magnesium particles when a temperature at a mediate lower position of the magnesium additive device is increased to reach a preset value, so that the pure magnesium particles form a magnesium vapor which is carried into a steel liquid by argon.

2. The method of claim 1, further comprising providing an argon regulating valve to introduce the argon whose flow rate is at the range of 0.5-1.5 L/min.

3. The method of claim 1, wherein the magnesium vapor is carried into the steel liquid by the argon whose flow rate is at the range of 0.2-0.5 L/min.

4. The method of claim 1, wherein each of the pure magnesium particles has a diameter of 0.5-2 mm.

* * * * *